US005911367A

United States Patent [19]

McInerney

[11] Patent Number: 5,911,367

[45] Date of Patent: Jun. 15, 1999

[54] CABLE TIE

[76] Inventor: Gregory Charles McInerney, 30 Buckley Grove, Moolap, Victoria, Australia, 3221

[21] Appl. No.: 09/074,330

[22] Filed: May 7, 1998

[51] Int. Cl.[6] ..... B65D 63/00

[52] U.S. Cl. ..... 24/16 PB; 24/17 AP

[58] Field of Search ..... 24/16 R, 16 PB, 24/17 A, 17 AP, 30.5 P; 248/74.3

[56] References Cited

U.S. PATENT DOCUMENTS

| | | | |
|---|---|---|---|
| 4,272,870 | 6/1981 | McCormick | 24/16 PB |
| 4,287,644 | 9/1981 | Durand | 24/17 AP |
| 4,507,828 | 4/1985 | Furutsu | 24/16 PB |
| 4,631,782 | 12/1986 | Gecs | 24/17 AP |
| 4,951,362 | 8/1990 | Denemark et al. | 24/16 PB |
| 4,958,414 | 9/1990 | Benoit | 24/17 AP X |
| 5,088,159 | 2/1992 | Lafleur | 24/17 AP X |
| 5,293,669 | 3/1994 | Sampson | 24/17 AP X |
| 5,644,819 | 7/1997 | Lyons | 24/16 PB X |
| 5,745,957 | 5/1998 | Khokhar et al. | 24/16 PB |

*Primary Examiner*—James R. Brittain
*Assistant Examiner*—Robert J. Sandy
*Attorney, Agent, or Firm*—Edwin D. Schindler

[57] ABSTRACT

A tie having a receptacle with an aperture there through, a lower edge of which includes at least one or more saw teeth or the like members which can engage with similar saw teeth members on the underside of a free end of the tie as it passes through the aperture, which lower edge is parallel to the surface of the body of the tie so that the free end, on connection, lies effectively on the periphery of the tie. The free end of the tie may be positively directed downwards towards the body of the tie as it passes through the receptacle by the provision of an upper inner curved surface within the aperture in the receptacle.

6 Claims, 1 Drawing Sheet

CABLE TIE

This invention relates to an improved tie and in particular, cable ties.

Cable ties, initially, were designed for use by electricians and include a strap of a synthetic plastics material at one end of which there is a receiver member, which has an aperture at right angles to the strap and saw teeth of the like within the aperture, the other end of the tie is generally tapered and has corresponding saw teeth there across, the arrangement being such that the free end of the tie can pass through the aperture in the other end of the tie and drawn there through by a ratcheting arrangement between the two sets of saw teeth until the articles located within the cable tie are firmly held together.

Practically, at that time, if required the free end of the tie closely adjacent the point of exit through the aperture can be cut off with diagonal cutters or the like. Alternatively in some applications such as in ducts the free end can simply be left extending.

Cable ties have in recent years become ubiquitous in applications other than electrical wiring and specifically in holding together the various wires of automotive looms.

Whilst ties have been very efficient at their primary function, holding together, there have been disadvantages. Firstly that if the free end is not cut off, or, more often if it is cut off at some distance away from the point of exit through the aperture, then it can be dangerous for any person, who, say, has to put an arm into a confined space around the tie, as the tie can well scratch or gash the person's arm.

Also ties which have not been cut off completely are rather unattractive, and as they may be used, for example, in holding computer cables together, this is undesirable.

The object of the present invention is to provide a new improved tie of the type generally referred to hereinbefore.

The invention in its broadest sense is a tie having a receptacle a lower edge of which includes at least one or more saw teeth or the like members which can engage with similar saw teeth members on the underside of a free end of the tie as it passes through the receptacle, which lower edge is parallel to the surface of the body of the tie so that the free end, on connection, lies effectively on the periphery of the tie.

It may be preferred to provide an upper guide in the aperture which tends to direct the free end downwardly so that it abuts the surface of the body of the tie.

In order that the invention may be more readily understood I shall describe one particular embodiment of the tie made in accordance with the invention in terms of the following drawings.

Figure 1:
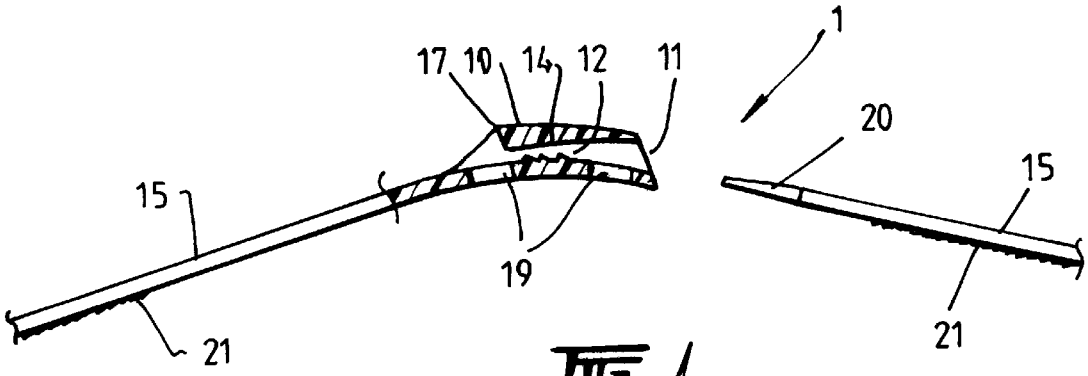
FIG. 1 is a schematic cross-section of the connection mechanism of the tie.
Figure 2:
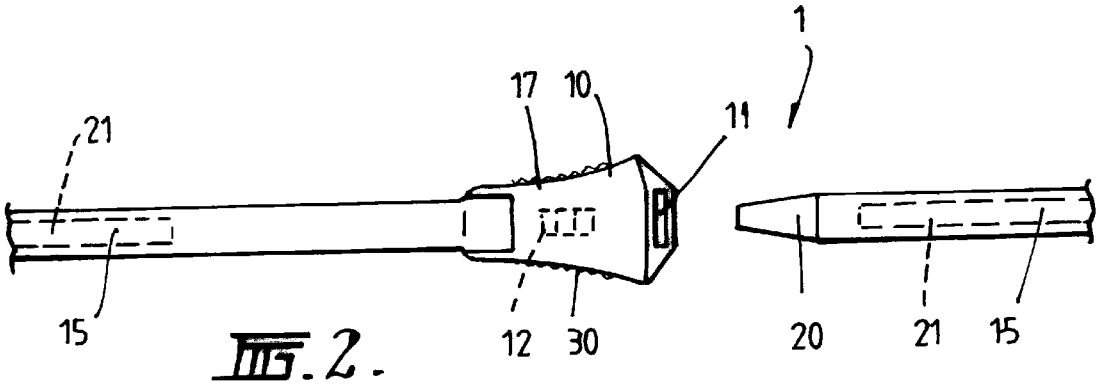
FIG. 2 is a schematic view of the tie connection mechanism viewed from above.
Figure 3:
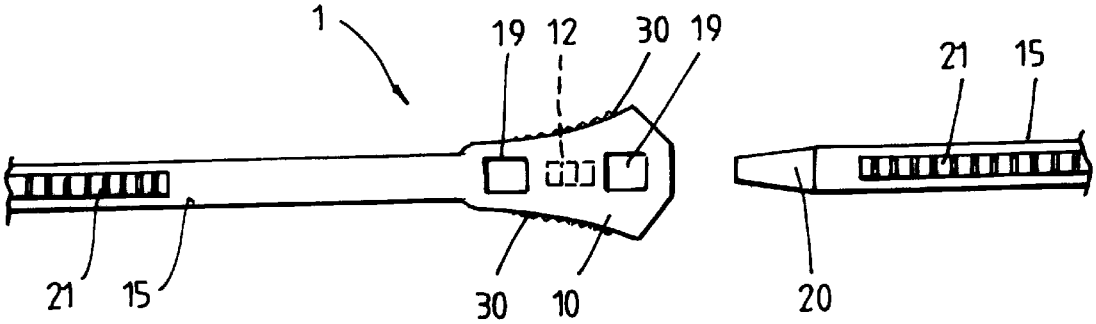
FIG. 3 is a schematic view of the tie connection mechanism as viewed from below.

Conventional cable ties are made by injection moulding of synthetic plastics material and this is a preferred method of manufacture of the tie of the invention although the tie can also be made from metal, as will be described.

In this embodiment of the invention the tie (1) is made of a synthetic plastics material, such as nylon, although other materials are equally useful. It is largely conventional in form in that it has an elongated, preferably rectangular in cross section body (15), although this shape is not essential, having at one end a receptacle (10) while the other end (20) is tapered both in width and in length.

The receptacle (10) has an aperture (11) there through which is generally of the shape of the body of the tie and is adapted to receive the body (15) of the tie therein and is provided with a number of saw teeth lying transversely there across with the ramps of the saw teeth (12) extending upwardly from the free end of the receptacle.

The top (17) of the receptacle can be defined in such a way that there is a downwardly extending portion (14) directed towards the body of the tie.

It is also preferred that the receptacle is provided with thumb and finger grips (30) on either side thereof.

The free end of the tie (20) is, as mentioned above, tapered both in thickness and in width and adjacent the end of the tapered portion and running rearwardly along the tie there can be a number of saw teeth (21) each located transversely to the tie and which are adapted to engage with the saw teeth members (12) in the body of the receptacle.

The receptacle (10) is also provided with windows (19) to facilitate the injection moulding process.

These tie features are conventional and the teeth (21) may extend only over a relatively short distance, if the tie is for specific applications, or can extend over a substantial portion of the length of the tie, if the tie is for more universal applications.

In use the tie is passed around the bundle of cables, the pipe or whatever is to be enclosed, and the free end is moved into the aperture (11) and through the receptacle and can be drawn therein with the saw teeth of the receptacle and the end ratcheting which means that at any position the tie is basically located and pressure can be applied to ensure the tightness required. The provision of the thumb and finger grips, assists in holding the tie during tightening.

As the body (15) of the tie passes through the aperture in the receptacle the upper curved surface (14) tends to cause it to move downwardly over the body adjacent the exit portion from the receptacle so that, if the free end is only relatively short, it will tend to lie close against the body or if longer the portion adjacent the exit point will tend to lie against the body, and if necessary, the portion of the free end can be cut off as has previously been the case.

In contradiction to the previous case, however, when the tie is cut off, the free end will tend to lie against the body of the remainder of the tie and not extend outwardly therefrom.

The tie of the invention includes also a tie characterised in that the aperture (11) through receptacle (10) which includes saw teeth or the like members and through which the free end of the tie passes is parallel to the surface of the body of the tie so that the free end, on connection, lies effectively on the periphery of the tie. It is preferred however that the free end of the tie be positively directed downwards towards the body of the tie by the provision of curved surface (14).

This means that the tie not only provides a better appearance than previously used ties, but also tends to enable working around the tie to be much safer for the operator than has previously been the case.

Whilst we have described herein a form of tie which has been manufactured by injection moulding from a plastics material it is also possible to make the tie of the invention from metal. In this case there is a metal strip which comprises the body of the tie and this can be formed with transverse deformations adjacent what will be the free end and which can correspond to the saw teeth of the previous embodiment although they may not be so clearly defined and at the other end of the tie there can be located either a metal or a plastics receptacle to receive this free end, which receptacle can be considered to be identical to that of the previous embodiment.

If the receptacle is to be of a plastics material this may be preferably moulded over the end of the strip which comprises the body and this may be provided with apertures or the like there through to ensure effective keying of the receptacle to the strip and if the receptacle is made of metal this may be crimped of otherwise connected to the strip to ensure that the two components are positively connected.

Once formed in operation this is effectively identical to the previous embodiment.

It will be seen that the tie of the invention provides a tie that can be manufactured at approximately the same price of previously known ties but which has definite advantages in use both from an aesthetic and a safety point of view.

Whilst we have described one particular form of construction of the tie it will be appreciated that the formation of what we refer to as saw teeth member can be modified without departing from the spirit or scope of the invention.

The claims defining the invention are as follows:

I claim:

1. A tie, comprising:

a receptacle having an aperture therethrough, said aperture having a lower edge which includes at least one or more saw teeth members, said aperture further including an upper inner curved surface; and, a free end of a tie element, said free end having an underside with at least one or more saw teeth members which are engageable with said at least one or more saw teeth members of said aperture of said receptacle as said free end of said tie element passes through said aperture of said receptacle, said lower edge of said aperture being parallel to a surface of a body of said tie element, so that said free end of said tie element, on connection, is positively directed downwards toward said body of said tie element as said free end of said tie element passes through said receptacle by the provision of said upper inner curved surface within said aperture in said receptacle.

2. The tie according to claim 1, wherein exterior sides of said receptacle are provided with thumb and finger grips.

3. The tie according to claim 1, wherein said saw teeth members on the underside of said free end of said tie element extend over a substantial portion of the length of said tie element.

4. The tie according to claim 1, wherein said tie is constructed from metal.

5. The tie according to claim 1, wherein said tie is constructed from a synthetic substance.

6. A method for securing cables to one another, said method comprising the step of:

connecting a receptacle having an aperture therethrough, said aperture having a lower edge which includes at least one or more saw teeth members, to a free end of a tie element, said free end having an underside with at least one or more saw teeth members which are engageable with said at least one or more saw teeth members of said aperture of said receptacle as said free end of said tie element passes through said aperture of said receptacle, said lower edge of said aperture being parallel to a surface of a body of said tie element, so that said free end of said tie element, on connection, is positively directed downwards toward said body of said tie element as said free end of said tie element passes through said receptacle by the provision of an upper inner curved surface within said aperture in said receptacle.

* * * * *